United States Patent [19]

Anderson et al.

[11] Patent Number: 4,923,597

[45] Date of Patent: May 8, 1990

[54] PORTABLE SCREEN WITH RAISING AND LEVELLING SYSTEM

[76] Inventors: Don W. Anderson, 1000 Karen Dr.; Robert Eddy, 704 E. 21st St.; Alan Egge, Rte. 2, Box 240, all of Yankton, S. Dak. 57078; Richard Lewison, 103 S. Side Dr., Pocahontas, Iowa 50574

[21] Appl. No.: 297,417

[22] Filed: Jan. 13, 1989

[51] Int. Cl.[5] ..... B07B 1/28

[52] U.S. Cl. ..... 209/420; 209/315; 209/319; 209/935; 212/189; 248/188.2; 254/423; 280/766.1

[58] Field of Search ..... 209/235, 319, 420, 412, 209/413, 416, 421, 315, 935; 254/423; 404/92; 212/189; 280/766.1, 6.1; 248/188.2, 188.4, 188.5; 241/94, 101.7

[56] References Cited

U.S. PATENT DOCUMENTS

| | | | |
|---|---|---|---|
| D. 263,836 | 4/1982 | Read | D15/147 |
| 1,806,934 | 5/1931 | Deister . | |
| 1,845,373 | 2/1932 | Weber . | |
| 3,033,523 | 5/1962 | Mulholland et al. | 254/86 |
| 3,307,698 | 3/1967 | Haffner | 209/258 |
| 3,627,268 | 12/1971 | Wills | 254/86 |
| 3,704,834 | 12/1972 | Nilsson et al. | 209/420 X |
| 3,909,401 | 9/1975 | Thompson | 209/421 X |
| 4,061,309 | 12/1977 | Hanser | 254/86 |
| 4,176,066 | 11/1979 | Sloan | 209/421 X |
| 4,197,194 | 4/1980 | Read | 209/325 |
| 4,237,000 | 12/1980 | Read et al. | 209/319 |
| 4,256,572 | 3/1981 | Read | 209/257 |
| 4,664,791 | 5/1987 | McClain et al. | 209/421 |
| 4,785,761 | 11/1988 | Greenbank | 209/935 |

FOREIGN PATENT DOCUMENTS

| | | | |
|---|---|---|---|
| 1273309 | 7/1968 | Fed. Rep. of Germany . | |
| 1077822 | 11/1954 | France . | |
| 1129725 | 1/1957 | France . | |
| 167068 | 4/1934 | Switzerland . | |
| 1194825 | 11/1985 | U.S.S.R. | 212/189 |

OTHER PUBLICATIONS

Hoehn Portable Screening Plant, no date.
Loader-Screen Portable Screening Plant, no date.
Kolberg 1400 no date.
Kolberg 1900 no date.
Kolberg 1800 no date.

*Primary Examiner*—Donald T. Hajec
*Attorney, Agent, or Firm*—Hill, Van Santen, Steadman & Simpson

[57] ABSTRACT

A portable screen with a raising and levelling system for raising a frame of the system containing a vibrating screen away from ground on which the system is positioned and for levelling the frame and vibrating screen for improved operation. A wheel assembly rigidly fixed relative to the frame extends from the frame at a first end wall where a first raising and levelling assembly is provided. At an opposite end wall of the frame, a second raising and levelling system is provided. First and second shedding roofs are respectively positioned over the wheel assembly and first and second hydraulic raising and levelling assemblies. With the portable screen having a raising and levelling system as disclosed, the system may be operated on sloping ground and/or ground having undulations and other protrubances.

10 Claims, 4 Drawing Sheets

PORTABLE SCREEN WITH RAISING AND LEVELLING SYSTEM

BACKGROUND OF THE INVENTION

The invention relates to portable screen systems.

Previously, it has been known to provide portable screen systems for separating fine material from coarse material wherein the frame of the unit is lowered flush onto preferably flat level ground, and material to be processed which overflows beyond side ends of the screen builds up along end sides of the unit. A set of wheels are made movable relative to the frame from an operative position for transporting the apparatus to an inoperative position for resting the frame flush on the ground. Such a unit is shown, for example, in U.S. Pat. Nos. 4,197,194, Des. 263,836, 4,237,000, and 4,256,572.

There are significant disadvantages with such a system. If the ground onto which the frame is rested in flush fashion is not level and/or bumpy and undulating, the vibrating screen will not be level side-to-side, and the material placed on the vibrating screen will be inefficiently processed and tend to shift more to one side of the screen than the other and thus be unevenly distributed. Accordingly, with the aforementioned unit, the ground on which the frame is positioned in flush manner should be level and not bumpy or undulating.

A further disadvantage is that during operation of the aforementioned unit, overflow material to the sides of the unit builds up around the wheels and the side walls and can interfere with removal of the unit from the site due to such build-up of overflow material. Also, build-up of material where the frame sits flush on the ground may impede removal during freezing weather if such material were to freeze and trap the frame.

Another disadvantage of the above described unit is that if the frame resting on the ground settles unevenly during operation, the unit may become tilted, particularly if a rock was in contact with one small portion of the frame.

SUMMARY OF THE INVENTION

It is an object of the present invention to provide a portable screen system which can be used on ground which is not necessarily level, and which may contain rocks and have surface undulations.

It is a further object of the invention to provide a system which can be easily removed from its operating location after operation has been completed.

It is another object of the invention to provide a portable screen system whose wheels are fixed relative to the frame and wherein the frame and wheels extending from and rigidly fixed to the frame are raised away from the ground such that the frame can be levelled with respect to the ground by selective operator control during operation as desired.

According to the invention, a first hydraulic raising and levelling assembly having a longitudinally extending horizontal base bar is attached to a frame of the system centrally of a first end wall of the frame. A wheel assembly rigidly fixed relative to the frame also extends from the frame at the first end wall. At an opposite second end wall of the frame, a second hydraulic raising and levelling assembly having a longitudinally extending horizontal base bar is provided which is attached to and extends from the frame at a central position of the second end wall. In the raised and levelling position, these assemblies raise and level the frame and a screen which it contains with respect to the ground as desired by an operator who can independently control hydraulics of the first and second assemblies. First and second slanted overflow material shedding roofs are provided substantially covering the entire wheel assembly and the region over the first and second raising and levelling assemblies. An oversized rectangular feed hopper, in combination with the first and second shedding roofs, prevents overflow material build-up around the first and second raising and levelling legs and the wheel assembly. The longitudinal base bars of the first and second assemblies run parallel to the first and second end walls and have a relatively narrow width compared to their length.

Additionally, a centrally peaked end-tensioned screen cloth arrangement is provided which, together with the levelling system of the invention, results in increased operational efficiency.

DESCRIPTION OF THE PREFERRED EMBODIMENTS

Figure 1:
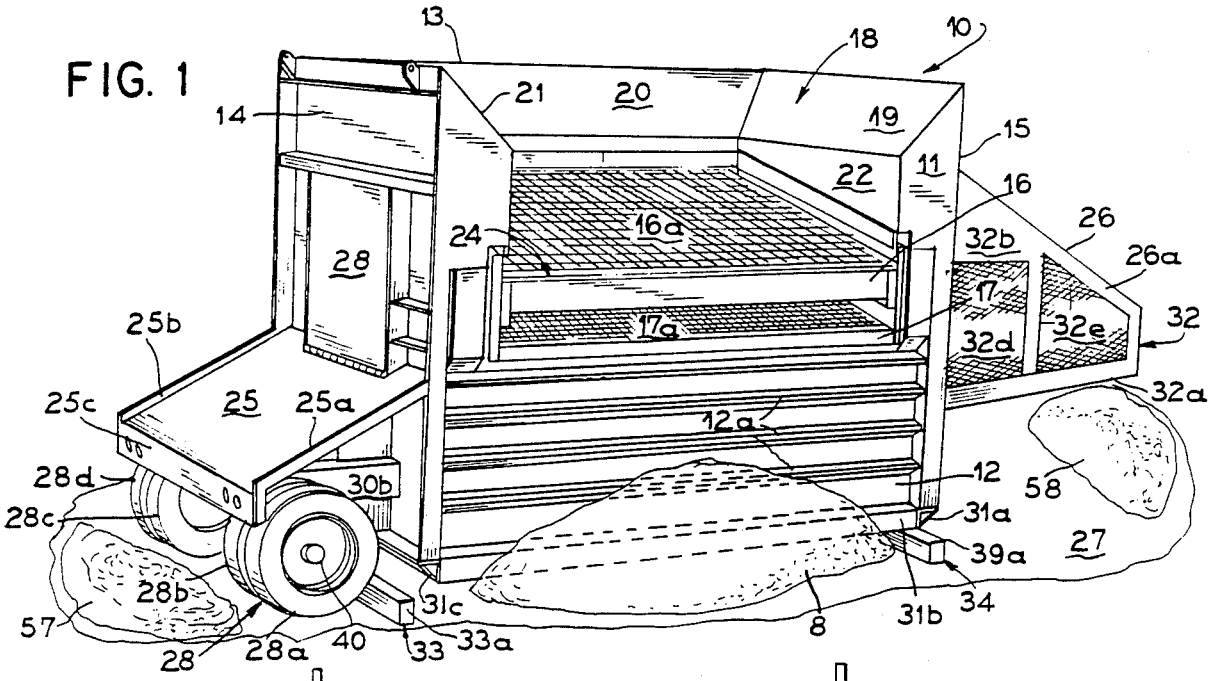
FIG. 1 is a perspective view of the portable screen with raising and levelling system of the invention.

The portable screen with raising and levelling system of the invention is generally shown at 10 in FIG. 1. The screen system has a frame 11 consisting of a ribbed short front end wall 12 being closed from the upper edge to the bottom edge thereof, a tall back end wall 13 having a lower open portion, a first end or side wall 14, and an opposite second end or side wall 15. The front end wall 12 has a plurality of triangular ribs 12*a*. Within this frame a double-deck screen assembly 24 is mounted, said screen assembly including a top screen 16 having an end-tensioned centrally peaked interchangeable screen cloth 16*a* and a bottom screen 17 having an end-tensioned centrally peaked interchangeable convex screen cloth 17*a*. A rectangular oversized feed hopper 18 is provided above the screen assembly 24 and formed of slanting side walls 19, 20, and 21, and vertical side walls 22 and 23 beneath the slanting side walls 19 and 21, respectively. Such a rectangular feed hopper is also simple to construct since angle cuts are reduced.

Extending from the first end wall 14 of the frame 11 is an inclined or slanting first shedding roof 25 having upturned guide edges 25*a* and 25*b*, and a vertical wall 25*c* at the end of the roof 25.

Figure 7:
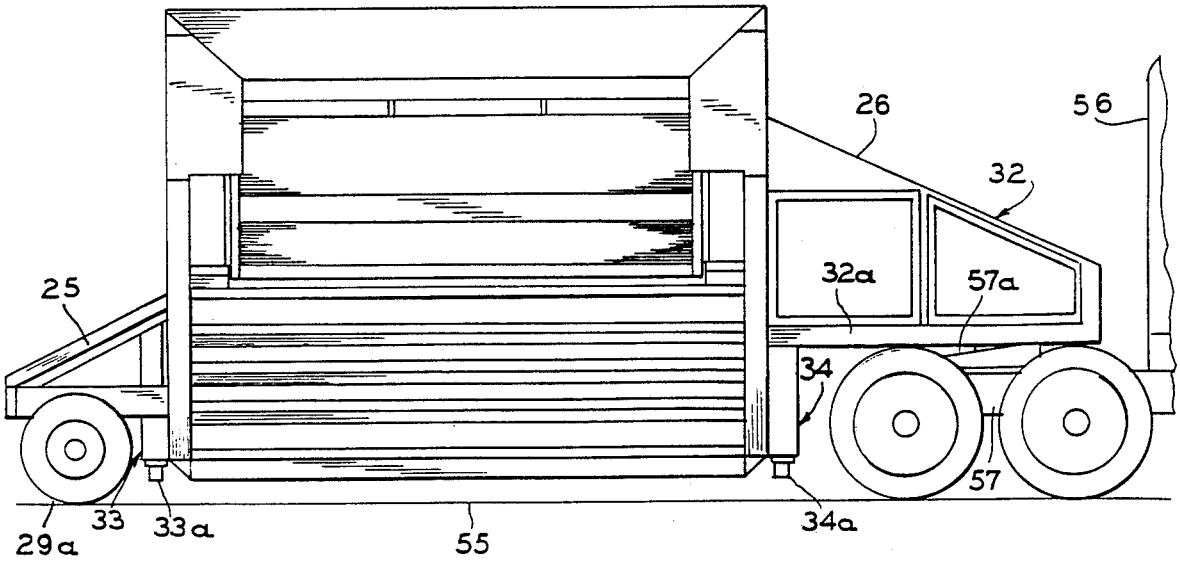
FIG. 7 is a front view of the system shown in FIG. 1 but in a transportation mode.

A second slanting shedding roof 26 having upturned side edges 26*a*, 26*b* is provided extending from the second end wall 15 of the frame 11 at a towing end of the screen system. This shedding roof 26 forms the ceiling of a single unified power pack enclosure 32 having a floor portion 32*a* serving as a mounting surface for towing of the system, such as shown in FIG. 7. The enclosure 32 is formed of side walls 32*b* and 32*c* having screened portions 32*d*, 32*e*.

A set of wheels 28*a, b, c, d* is rigidly fixed relative to and are extended from the frame 11 by spaced horizontal extending strut bars 30*a*, 30*b* extending from the frame 11. The four wheels 28*a, b, c, d*, on a common axle 40 are part of the overall wheel assembly 28.

The bottom end of the frame 11 terminates in triangular frame edges 31*a*, 31*c* and a front edge 31*b*.

A first hydraulic raising and levelling assembly 33 extends and is centrally connected to the frame 11 and has a horizontal longitudinal base bar 33*a* which is extendable and retractable so as to raise and level the frame 11 relative to ground 27. The base bar 33*a* is preferably rectangular in cross section and has a longitudinal extent running parallel to the first end wall 14. The base bar 33*a* has a longitudinal extent of at least approximately two-thirds of a width of the frame 11 at end wall 14 and can be as long as the width of the frame but is preferably sufficiently short of the entire width so as not to interfere with a payloader operating near the system. The base bar preferably has a width of approximately 4 inches with 3 inches and 6 inches as approximate upper limits on the width.

A second hydraulic raising and levelling assembly 34 is centrally attached to the frame 11 at the second end wall 15. Assembly 34 includes a base bar 34*a* substantially the same as base bar 33*a* and lies in contact with the ground 27. When the assembly is extended, it raises and levels the frame 11 relative to the ground 27 as shown most clearly in FIGS. 5 and 6.

Both the first and second raising and levelling assemblies are centrally aligned with respect to the first and second end walls 14 and 15.

Figure 2:
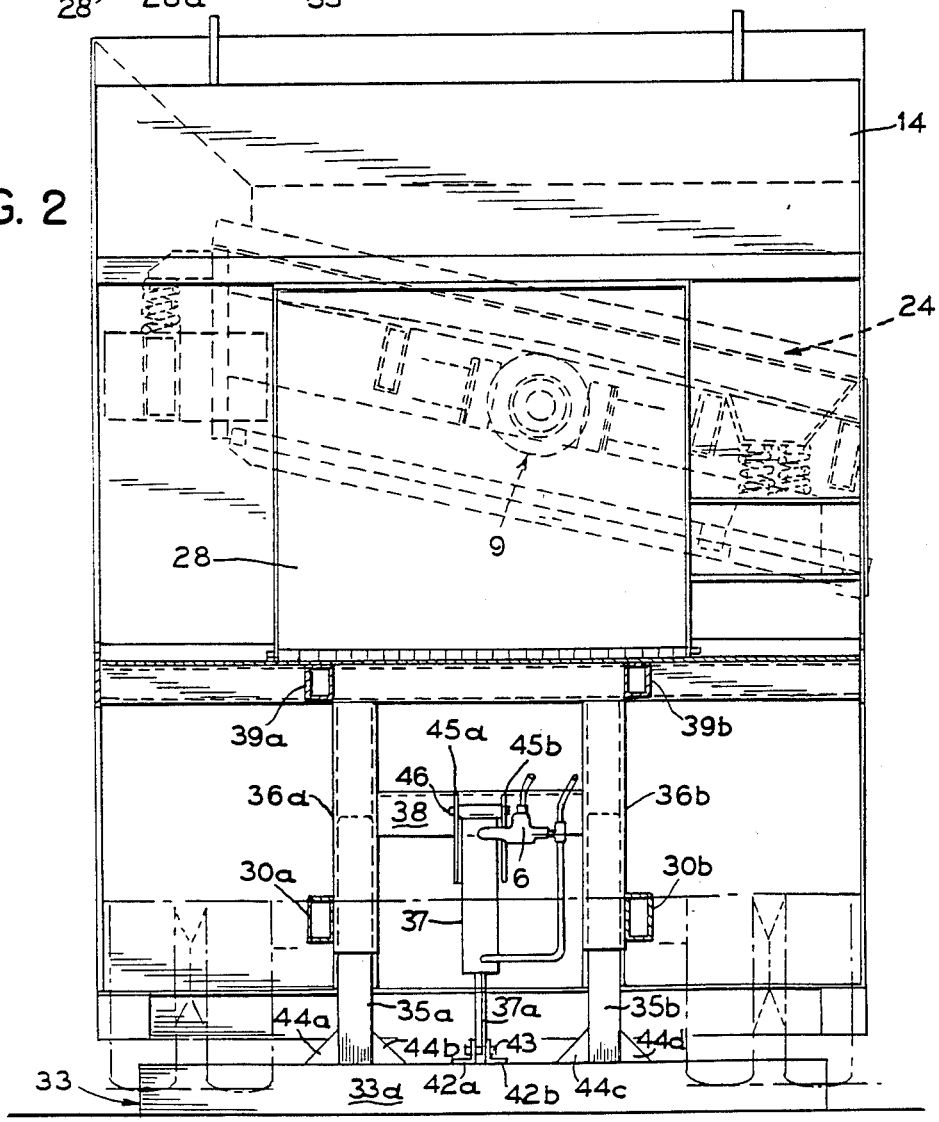
FIG. 2 is an end view of a first end of the screen system at which a rigidly fixed wheel assembly extends from a frame of the system.

In the end view at the first end wall 14 shown in FIG. 2, the structure of the first hydraulic raising and levelling assembly 33 is more clearly shown. The base bar 33*a* has first and second telescoping cylindrical support tubes 35*a* and 35*b* joined at right angles to the base bar 33*a* which are separated from one another and spaced inwardly of the ends of the bar 33*a*. These tubes 35*a* and 35*b* are respectively received in cylindrical guide tubes 36*a* and 36*b* in telescopic fashion. The bars 35*a* and 35*b* are joined to the base bar 33*a* by triangular reinforcement plates 44*a*, 44*b*, 44*c*, 44*d*.

A hydraulic cylinder 37 having a drive arm 37*a* is provided such that a leading end of the drive arm 37*a* is secured to a top of the base bar 33 by L-shaped plates 42*a*, 42*b*, and pin 43. The opposite end of the hydraulic cylinder 37 connects to the first end wall 14 of the frame by mounting plates 45*a*, 45*b* and pin 46. These mounting plates are mounted on a horizontal support and spacing bar 38 attached to the first end wall 14.

The first and second guide tubes 36*a*, 36*b* are securely fastened directly to the end wall 14 by respective U-shaped channel members 7*a* and 7*b* (See FIG. 3) such as by welding. End wall 14 is also strengthened at this point by bars 6*a* and 6*b* (See FIG. 3).

The horizontal strut bars 30*a*, 30*b* are also attached such as by welding directly to and exteriorly of the first and second guide tubes 36*a*, 36*b*. Also, slanting support bars 39*a*, 39*b* (see FIG. 6) are provided so as to form a triangle together with the horizontal bars 30*a*, 30*b* as more clearly shown in FIGS. 5, 6, and 7. The first shedding roof 25 rests and is fastened to these slanted bars 39*a*, 39*b*.

Figure 3:
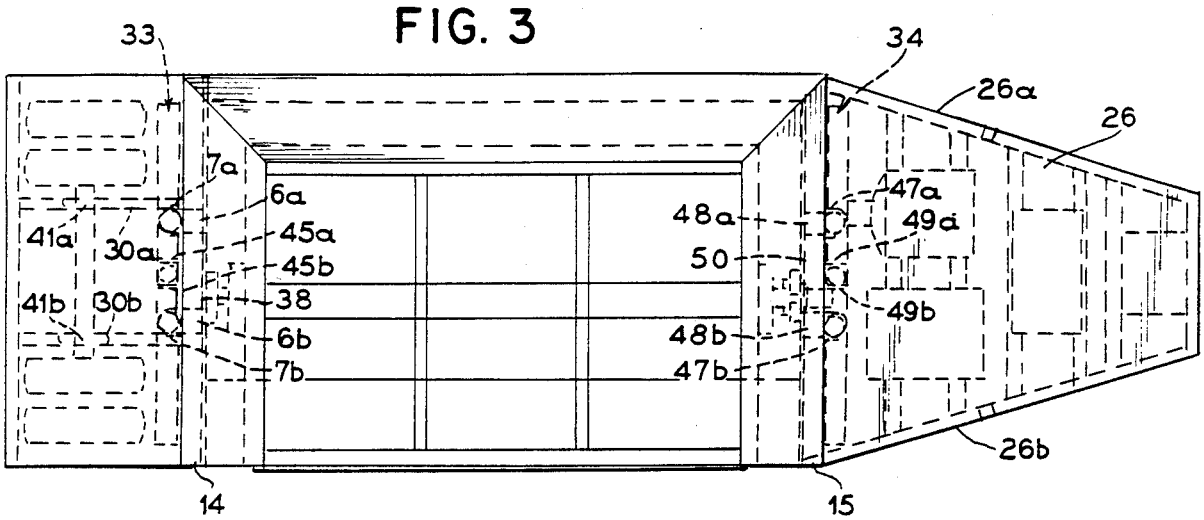
FIG. 3 is a top view of the system shown in FIG. 1.
Figure 6:
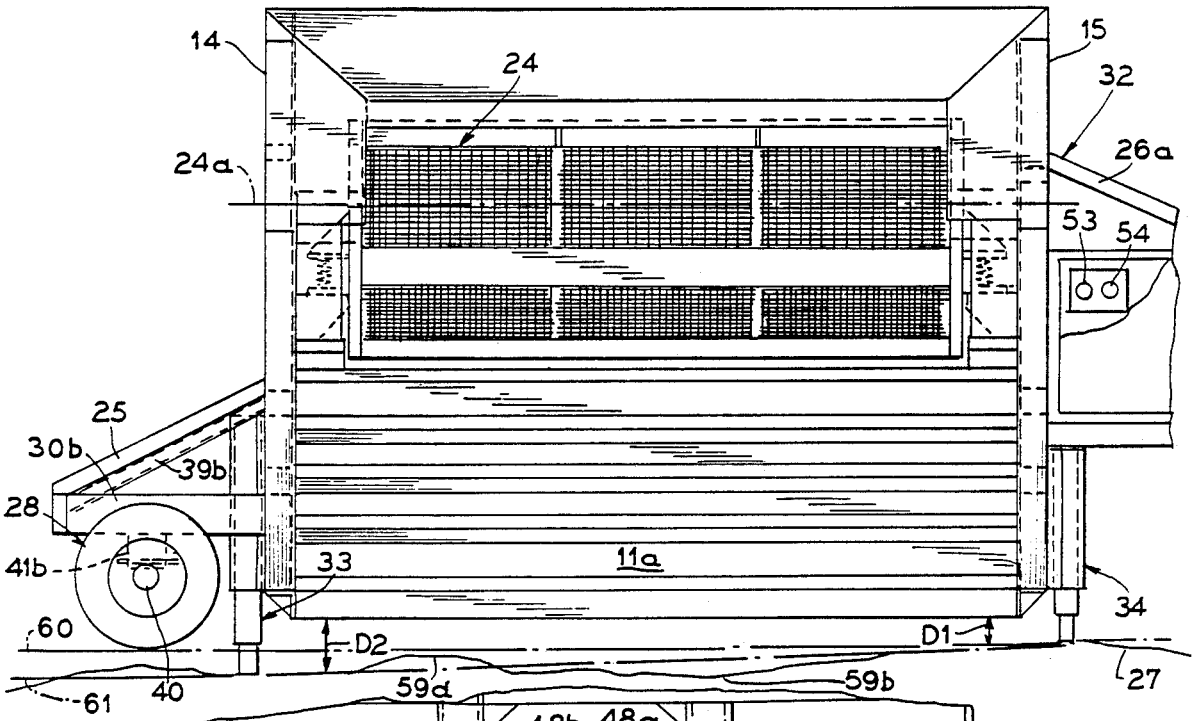
FIG. 6 is a front view of the system shown in FIG. 1 with the frame of the system raised and levelled with respect to the ground.

The axle 40 of the wheel assembly 28 attaches the spacing members 41*a*, 41*b* (as shown in FIGS. 3 and 6) in rigid fashion to the horizontal struts 30*a*, 30*b* so that the wheel assembly 28 extending from the frame 11 is rigidly fixed and non-movable relative to the frame 11.

Attached to the hydraulic cylinder is a pressure holding or check valve 6 for maintaining hydraulic pressure in the cylinder until release.

As also shown in both FIGS. 1 and FIG. 2, a trap door 28 is provided for access to the vibration mechanism 9 of the screen assembly 24.

Figure 4:
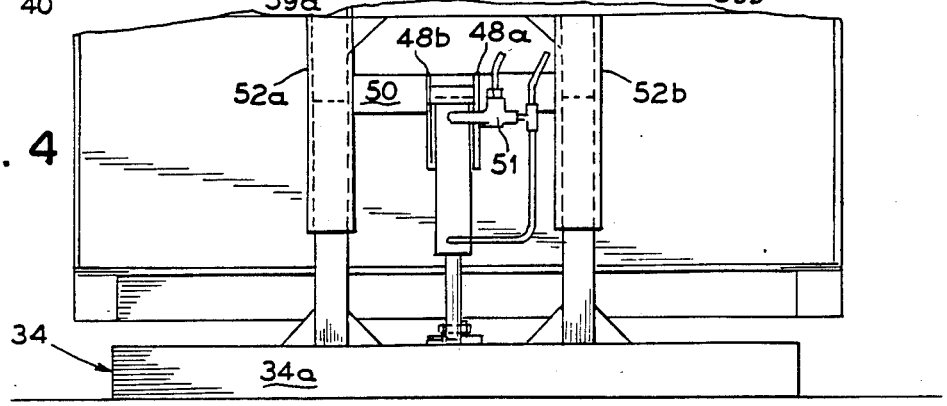
FIG. 4 is an end view of a second end opposite the first end of the system shown in FIG. 1.

Referring now to FIGS. 3 and 4, details of the second hydraulic raising and levelling assembly 34 is illustrated. The design of assembly 34 and its base bar 34*a* is substantially identical to the design of the first hydraulic raising and levelling assembly 33 and thus will not be repeated here. Also, in a fashion similar to assembly 33, U-shaped channels 47*a*, 47*b* secure the assembly guide tubes 52*a*, 52*b* to the end wall 15 and brace bars 48*a*, 48*b* are provided thereat. Furthermore, the upper end of the hydraulic cylinder is attached by side plates 49*a*, 49*b*, and bar 50 as shown. A check valve 51 is also provided.

Hydraulic control buttons or levers 53 and 54 (shown in FIG. 6) for respective independent hydraulic selective control of each of the raising and levelling assemblies 33 and 34 by an operator are provided in the power pack enclosure 32 containing a motor to provide hydraulic power to vibrate the shaker screen and operate the hydraulic raising and levelling assemblies 33 and 34.

Figure 5:
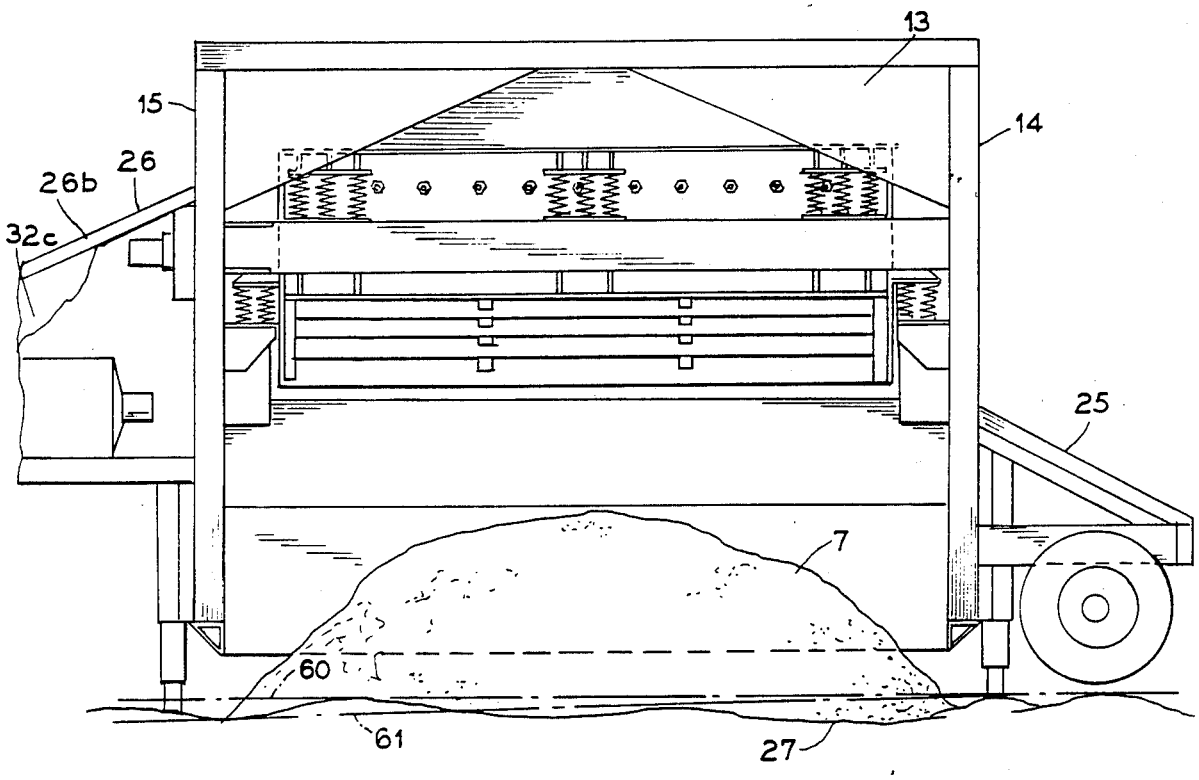
FIG. 5 is a back view of a back end of the screen system shown in FIG. 1.

Referring now to FIGS. 1, 5, and 6, system 10 of the invention is shown positioned on sloping ground 27 (most clearly illustrated in FIGS. 5 and 6) which, in addition to being sloping, may also have surface undulations or bumps 59*a* and 59*b*, for example. In FIG. 6, line 61 shows an averaged slope of the ground 27 relative to a horizontal level line 60. As can be seen, the hydraulic raising and levelling assemblies 33 and 34 have been adjusted individually by selective hydraulic operator control with control levers 53 and 54 such that a bottom edge 11*a* of the frame and a horizontal level line 24*a* of the screen assembly 24 is parallel to the desired horizontal level line 60. Thus, for example, the distance D1 near the second end wall 15 will be less than the distance D2 near the first end wall 14.

As shown in FIG. 7, in a transportation mode a towing vehicle 56 having a flat bed 57 with a hitch arrangement 57*a* preferably underlies the floor portion 32*a* of the unified enclosure 32. In this mode, the base bars 33*a* and 34*a* of the first and second raising and levelling hydraulic assemblies 33 and 34 are in a retracted position. Thus, the four wheels 29*a, b, c, d* are in contact with the roadway 55 during transportation of the system.

Figure 8:
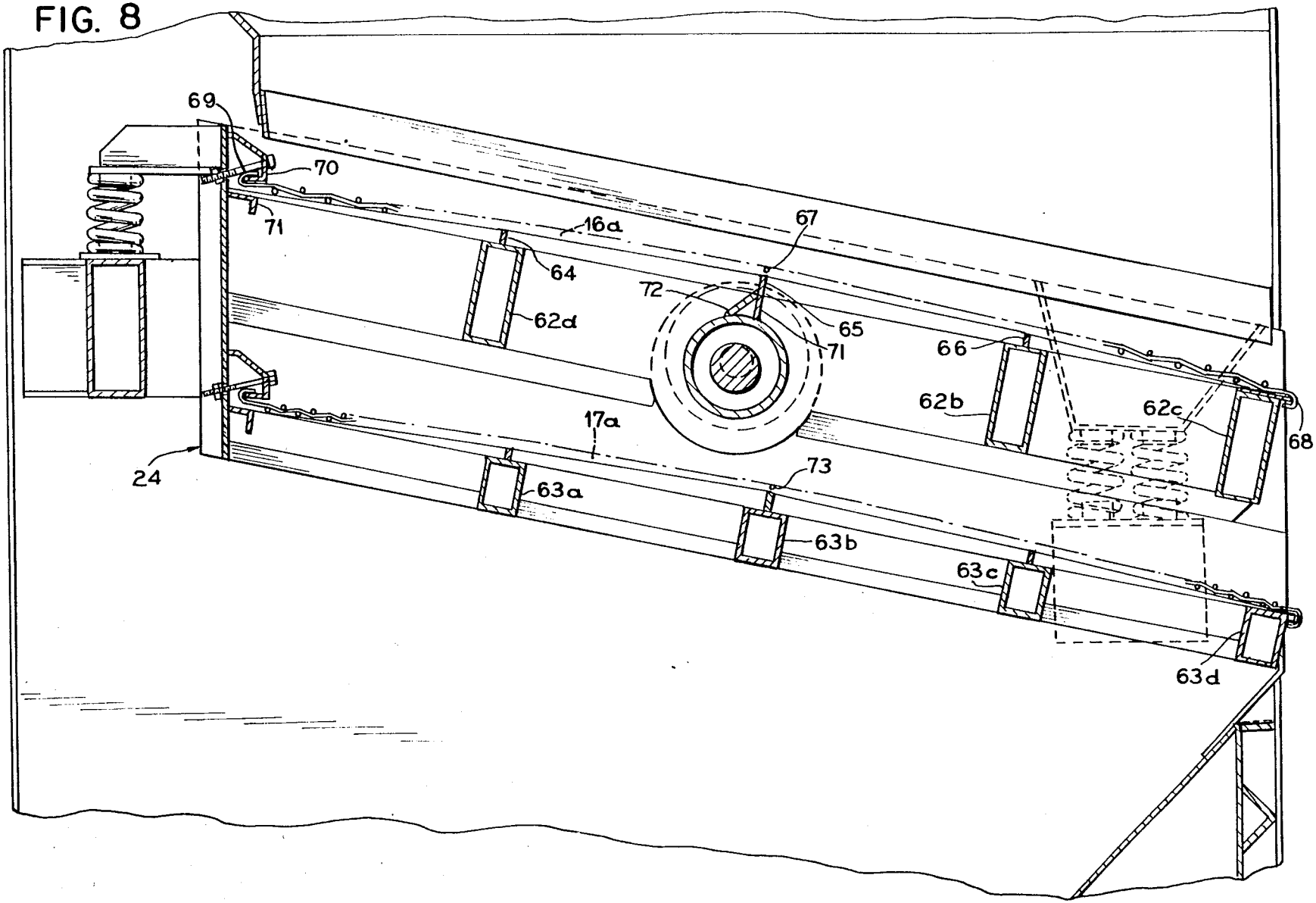
FIG. 8 is a cross-sectional view of the screen assembly shown in FIG. 1 showing a centrally peaked end-tensioned screen arrangement.

A detail of the screen assembly 24 is shown in FIG. 8. Here the upper screen cloth 16*a* is supported in upwardly peaked fashion by rectangular cross-pieces 62*a, b, c*, center support 71 and bracket 72. Extensions 64 and 66 and a longer extension shown at 65 centrally for center support 71 located on the screen 16*a* provide a peak at 67. Thus, an approximate symmetry line along the peak such as shown by the dot at peak 67 runs parallel to the front end of the unit. Furthermore, the screen 16*a* is end-tensioned as shown at hooked portions 68 at the front end of the unit and 69 at the back end of the unit. A bracket 70 is provided at the back end of the unit which engages at the hooked portion 69. A similar arrangement is provided for the bottom screen 17*a* which is peaked at line 73 (shown as a dot) in similar fashion and rests on rectangular cross-section cross supports 63*a*, 63*b*, 63*c*, and 63*d* of lesser cross-sectional height than the aforementioned crosspieces 62*a*, 62*b*, 62*c*.

As shown in FIG. 1, during operation of the unit, the frame 11 is raised away from the ground through extension of the raising and levelling assemblies 33 and 34. Thus, if the ground is not level and/or if the ground has protruding rocks and/or other undulations, the unit can still be positioned at such a location since the frame can be levelled through independent operation of the hydraulics to each of the lifting and levelling assemblies. Furthermore, if either of the base bars settles in the ground at some point in time during operation or between operations, the unit can be relevelled.

As shown in FIG. 1, material to be screened is fed into the over-sized hopper 18. Unscreened or partially screened material from the upper screen 16 falls in a pile 18 on ground 27 at a front of the system. Screened material forms in a pile 7 beneath the screen 24 as shown in FIG. 5. As shown in FIG. 1, the first and second shedding roofs 25 and 26 shield the base bars 33*a* and 34*b* and entire wheel assembly 28 from overflowing unscreened material falling beyond the end walls 13 and 15 and over-sized hopper portions 19 and 21 during loading of the screen system by a payloader, a conveyor, or the like. Also, the oversized rectangular feed hopper 18 having vertical side walls 22 and 23 reduces the amount of overflow of unscreened material shown at 57 and 58. Accordingly, when operation is finished, when it is desired to move the screen system, it is only necessary to retract the base bars 33*a* and 34*b* and the unit can then be towed away without significant obstructions. Furthermore, during operation the base bars 33*a* and 34*a* compact the soil lying therebeneath to provide a firm foundation for the unit, regardless of rocks or undulations such as 59*a* and 59*b* in the ground 27, as shown in FIGS. 5 and 6.

Also, with the screen structure as shown in FIG. 8, screen life is improved and the individual screens can be tightly tensioned in a direction of the unscreened material flow through the end-tensioning and peaking structure provided.

Although various minor changes and modifications might be proposed by those skilled in the art, it will be understood that we wish to include within the claims of the patent warranted hereon all such changes and modifications as reasonably come within our contribution to the art.

We claim as our invention:

1. A portable screen with raising and levelling system to permit levelling during screening operation on non-level and uneven ground, comprising:

a rectangular frame with a screen assembly mounted therein below a top of the frame, said top of the frame forming a feed hopper means for loading material to be screened onto the screen assembly, the frame having a first end wall, a second end wall opposite said first end wall, and a front end wall having a bottom edge which is spaced from the ground during screening operation;

means for shaking the screen assembly;

a set of wheels on an axle and means for attaching and rigidly fixing the axle with its set of wheels in fixed non-movable fashion relative to the frame at said first end wall thereof such that said wheels remain in a same relative position to the frame in both the screening operation and transport and such that a bottommost portion of said wheels always extends below bottom edges of the frame;

means for connecting the frame to a two vehicle being provided adjacent said second end wall;

a first hydraulic raising and levelling assembly attached in substantially laterally centered fashion to an exterior surface of the first end wall of the frame, and a second hydraulic raising and levelling assembly attached in substantially laterally centered fashion to an exterior surface of the second end wall of the frame;

the first and second hydraulic raising and levelling assemblies each having a rectangular base bar having a longitudinal extent parallel to the first and second end walls and a length at least two-thirds a length of a width of the frame, said base bars being laterally centered relative to a width of the frame at the end walls, guide means for guiding the base bars during extending and retracting movement along a vertical path, and hydraulic means for driving the base bars along the vertical path;

the first and second raising and levelling assemblies each having first and second telescoping tubes each with a first end and an opposite second end and whose longitudinal extent is perpendicular to the base bar and which are attached at their respective first ends to the base bar and at their respective second ends are telescopically received within respective first and second tubular members attached to the exterior of the frame at the respective first and second end walls, and wherein said hydraulic means for each of the levelling assemblies is substantially centrally positioned between the first and second telescoping tubes with one end of the hydraulic means connecting to the base bar and an opposite end attached to the respective frame end walls; and hydraulic control means for independently adjusting the hydraulic means of the first and second assemblies so as to selectively raise and space the bottom edge of the frame away from the ground such that the screen assembly is horizontally levelled in desired fashion in a direction from the first end wall to the second end wall, so that non-level ground conditions beneath the frame are selectively compensated for.

2. A portable screen according to claim 1 wherein the feed hopper means has three upper edges, and wherein all three upper edges of the feed hopper means lie in a substantially horizontal plane when the frame is horizontally levelled.

3. A portable screen according to claim 1 wherein a first slanted shedding roof is provided substantially entirely overlying all of the wheels and the first hydraulic raising and levelling assembly, and a second slanted shedding roof is provided extending from the frame and overlying the second hydraulic raising and levelling assembly.

4. A portable screen according to claim 3 wherein the second shedding roof forms a ceiling of a triangular shaped enclosure enclosing a power source for the screen, and wherein a floor of the enclosure has means for connecting the portable screen to a towing means, said means for connecting being positioned beneath the enclosure floor.

5. A portable screen according to claim 1 wherein the base bar has a width of at least 3 inches and less than 6 inches.

6. A portable screen according to claim 1 wherein the screen assembly is slanted in a direction from a back end of the frame toward a front end wall and has means for end-tensioning at least one screen thereof in a direction parallel to the slant direction of the screen assembly, and means for providing a raised peak running along a central portion of the screen in a direction parallel to the front end wall.

7. A portable screen with raising and levelling system to permit levelling during screening operation on non-level and uneven ground, comprising:

a rectangular frame with a screen assembly mounted therein below a top of the frame, said top of the frame forming a feed hopper means for loading material to be screened onto the screen assembly, the frame having a first end wall, a second end wall opposite said first end wall, and a front end wall having a bottom edge which is spaced from the ground during screening operation and and means for mounting the screen assembly within the frame in slanted fashion;

means for shaking the screen assembly;

a set of wheels on an axle and means for attaching and rigidly fixing the axle with its set of wheels in fixed non-movable fashion relative to the frame at said first end wall thereof such that said wheels remain in a same relative position to the frame in both the screening operation and transport and such that a bottommost portion of said wheels always extends below bottom edges of the frame;

means for connecting the frame to a tow vehicle being provided adjacent said second end wall;

a first hydraulic raising and levelling assembly attached to the first end wall of the frame, and a second hydraulic raising and levelling assembly attached to the second end wall of the frame;

the first and second hydraulic raising and levelling assemblies each having a rectangular base bar having a longitudinal extent parallel to the first and second end walls and a length at least two-thirds a length of a width of the frame, telescoping guide means for guiding the base bars during extending and retracting movement along a vertical path, and hydraulic means for driving the base bars along the vertical path;

the first and second raising and levelling assemblies each having first and second telescoping tubes each with a first end and an opposite second end and whose longitudinal extent is perpendicular to the base bar and which are attached at their respective first ends to the base bar and at their respective second ends are telescopically received within respective first and second tubular members attached to the exterior of the frame at the respective first and second end walls, and wherein said hydraulic means for each of the levelling assemblies in substantially centrally positioned between the first and second telescoping tubes with one end of the hydraulic means connecting to the base bar and an opposite end attached to the respective frame end walls; and hydraulic control means for independently adjusting the hydraulic means of the first and second assemblies so as to selectively raise and space the bottom edge of the frame away from the ground such that the screen assembly is horizontally levelled in desired fashion in a direction from the first end wall to the second end wall, so that non-level ground conditions beneath the frame are selectively compensated for.

8. A portable screen with raising and levelling system to permit levelling during screening operation on non-level and uneven ground, comprising:

a rectangular frame with a screen assembly mounted therein below a top of the frame, said top of the frame forming a feed hopper means for loading material to be screened onto the screen assembly, the frame having a first end wall, a second end wall opposite said first end wall, and a front end wall having a bottom edge which is spaced from the ground during screening operation;

means for shaking the screen assembly;

a set of wheels on an axle and means for attaching and rigidly fixing the axle with its set of wheels in fixed non-movable fashion relative to the frame at said first end wall thereof such that said wheels remain in a same relative position to the frame in both the screening operation and transport and such that a bottommost portion of said wheels always extends below bottom edges of the frame;

means for connecting the frame to a tow vehicle being provided adjacent said second end wall;

a hydraulic raising and levelling assembly attached in substantially laterally centered fashion at the second end wall of the frame;

the hydraulic raising and levelling assembly having a rectangular base bar having a longitudinal extent parallel to the second end wall and a length at least two-thirds a length of a width of the frame, guide means for guiding the base bar during extending and retracting movement along a vertical path, and hydraulic means for driving the base bar along the vertical path;

the raising and levelling assembly having first and second telescoping tubes each with a first end and an opposite second end and whose longitudinal extent is perpendicular to the base bar and which are attached at their respective first ends to the base bar and at their respective second ends are telescopically received within respective first and second tubular members attached to the exterior of the frame at the second end wall, and wherein said hydraulic means is substantially centrally positioned between the first and second telescoping tubes with one end of the hydraulic means connecting to the base bar and an opposite end attached to the frame second end wall; and hydraulic control means for adjusting the hydraulic means of the hydraulic raising and levelling assembly so as to selectively raise and space the bottom edges of the frame at the second end wall away from the ground such that the screen assembly is horizontally levelled in desired fashion in a direction from the first end wall to the second end wall, so that non-level ground conditions beneath the frame are selectively compensated for.

9. A portable screening apparatus for separating coarse material from finer material, comprising:

a frame of generally rectangular cross section and having a tall end and a short end joined by sides, said short end being closed from an upper edge of said short end to a bottom edge thereof, said bottom edge of said frame being spaced from ground during screening operation, and the lower portion of said tall end being open, a material separating shaker screen sloping downwardly from near the upper edge of said tall end to near the upper edge of said short end;

a set of wheels mounted to one of said sides and rigidly fixed and non-movable relative to said frame such that said wheels remain in a same relative position to the frame in both the screening operation and transport;

a trailer hitch mounted to the other of said sides;

a first hydraulic raising and levelling assembly attached in substantially laterally centered fashion at one side of the frame, and a second hydraulic raising and levelling assembly attached in substantially laterally centered fashion at the other side of the frame;

the first and second hydraulic raising and levelling assemblies each having a rectangular base bar having a longitudinal extent parallel to the sides and a length at least two-thirds a length of a width of the frame, guide means for guiding the base bars during extending and retracting movement along a vertical path, and hydraulic means for driving the base bars along the vertical path;

the first and second raising and levelling assemblies each having first and second telescoping tubes each with a first end and an opposite second end and whose longitudinal extent is perpendicular to the base bar and which are attached at their respective first ends to the base bar and at their respective second ends are telescopically received within respective first and second tubular members attached to the exterior of the frame at the respective first sides, and wherein said hydraulic means for each of the levelling assemblies is substantially centrally positioned between the first and second telescoping tubes with one end of the hydraulic means connecting to the base bar and an opposite end attached to the respective frame sides; and hydraulic control means for independently adjusting the hydraulic means of the first and second assemblies so as to selectively raise and space the frame away from the ground during the screening operation and to adjust the frame with the screen assembly such that it is horizontally levelled in desired fashion in a direction from the one side to the other side for the screening operation so that non-level ground conditions can be selectively compensated for.

10. A portable screening apparatus for separating coarse material from finer material, comprising:

a frame of generally rectangular cross section and having a tall end and a short end joined by sides, said short end being closed from an upper edge of said short end to a bottom edge thereof, said bottom edge of said frame being spaced from ground during screening operation, and the lower portion of said tall end being open.

a material separating shaker screen sloping downwardly from near the upper edge of said tall end to near the upper edge of said short end;

a set of wheels mounted to one of said sides and rigidly fixed and non-movable relative to said frame such that said wheels remain in a same relative position to the frame in both the screening operation and transport;

a trailer hitch mounted to the other of said sides;

a hydraulic raising and levelling assembly attached in substantially laterally centered fashion at the other side of the frame;

the hydraulic raising and levelling assembly having a rectangular base bar having a longitudinal extent parallel to the sides and a length at least two-thirds a length of a width of the frame, guide means for guiding the base bar during extending and retracting movement along a vertical path, and hydraulic means for driving the base bar along the vertical path;

the raising and levelling assembly having first and second telescoping tubes each with a first end and an opposite second end and whose longitudinal extent is perpendicular to the base bar and which are attached at their respective first ends to the base bar and at their respective second ends are telescopically received within respective first and second tubular members attached to the exterior of the frame at the side at which the trailer hitch is mounted, and wherein said hydraulic means is substantially centrally positioned between the first and second telescoping tubes with one end of the hydraulic means connecting to the base bar and an opposite end attached to the side at which the trailer hitch is mounted; and hydraulic control means for adjusting the hydraulic means of the hydraulic raising and levelling assembly so as to selectively raise and space the frame at said other side away from the ground during the screening operation and to adjust the frame with the screen assembly such that it is horizontally levelled in desired fashion in a direction from the one side to the other side for the screening operation so that non-level ground conditions can be selectively compensated for.

* * * * *